US010471295B1

(12) United States Patent
Zillich

(10) Patent No.: US 10,471,295 B1
(45) Date of Patent: Nov. 12, 2019

(54) ADJUSTABLE-WIDTH PORTABLE BALANCING PLATFORM

(71) Applicant: Genevieve Zillich, Tampa, FL (US)

(72) Inventor: Genevieve Zillich, Tampa, FL (US)

( * ) Notice: Subject to any disclaimer, the term of this patent is extended or adjusted under 35 U.S.C. 154(b) by 0 days.

(21) Appl. No.: 16/426,425

(22) Filed: May 30, 2019

Related U.S. Application Data

(62) Division of application No. 16/149,431, filed on Oct. 2, 2018, now Pat. No. 10,343,011.

(51) Int. Cl.
*A63B 21/00* (2006.01)
*A63B 21/068* (2006.01)
(Continued)

(52) U.S. Cl.
CPC ..... *A63B 21/4034* (2015.10); *A63B 21/026* (2013.01); *A63B 21/0442* (2013.01);
(Continued)

(58) Field of Classification Search
CPC ..... A63B 21/00058; A63B 21/00061; A63B 21/00065; A63B 21/00069; A63B 21/00072; A63B 21/00076; A63B 21/000178; A63B 21/00181; A63B 21/00185; A63B 21/00189; A63B 21/008; A63B 21/0083; A63B 21/0085; A63B 21/0087; A63B 21/02; A63B 21/021; A63B 21/022; A63B 21/023; A63B 21/025; A63B 21/026; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/0615; A63B 21/0616; A63B 21/0617; A63B 21/068; A63B 21/15; A63B 21/159; A63B 21/4027; A63B 21/4033; A63B 21/4034; A63B 21/4045; A63B 21/4047; A63B 21/4049; A63B 22/0025; A63B 22/0046; A63B 22/0048; A63B 22/0056; A63B 22/04; A63B 22/16; A63B 22/18; A63B 22/20; A63B 22/201; A63B 22/203; A63B 22/205; A63B 2022/0038; A63B 2022/0051; A63B 2022/185; A63B 2022/206; A63B 23/035; A63B 23/03516; A63B 23/03533; A63B 23/03541; A63B 23/04; A63B 23/0405; A63B 23/0429;
(Continued)

(56) References Cited

U.S. PATENT DOCUMENTS 1,911,390 A * 5/1933 Pullman ..... A61H 1/0266 482/79
3,295,847 A * 1/1967 Matt, Sr. ..... A63B 22/16 482/80

(Continued)

*Primary Examiner* — Gary D Urbiel Goldner
(74) *Attorney, Agent, or Firm* — Larson & Larson, P.A.; Justin P. Miller; Frank Liebenow

(57) ABSTRACT

A portable balancing device is formed from a pair of modules connected by a width-adjusting mechanism. Each module may also be referred to as half of the pair of modules. Each module is formed from an upper platform and a lower platform. The upper and lower platforms are separated by compressible elements that deform under a user's weight.

8 Claims, 5 Drawing Sheets

(51) Int. Cl.

| | |
|---|---|
| ***A63B 71/00*** | (2006.01) |
| ***A63B 22/18*** | (2006.01) |
| ***A63B 21/04*** | (2006.01) |
| ***A63B 21/02*** | (2006.01) |
| ***A63B 26/00*** | (2006.01) |

(52) U.S. Cl.
CPC ..... *A63B 21/068* (2013.01); *A63B 22/18* (2013.01); *A63B 71/0036* (2013.01); *A63B 2026/006* (2013.01)

(58) Field of Classification Search
CPC . A63B 23/0482; A63B 23/0494; A63B 23/08; A63B 23/085; A63B 23/10; A63B 2023/0452; A63B 26/00; A63B 26/003; A63B 69/0028; A63B 69/0035; A63B 71/0036; A63B 71/0054; A63B 2071/0063; A63B 2071/0072; A63B 2208/0204; A63B 2208/0209; A63B 2210/00; A63B 2210/50; A63B 2225/09; A63B 2225/093
See application file for complete search history.

(56) References Cited

U.S. PATENT DOCUMENTS 3,641,601 A * 2/1972 Sieg ..... A63B 21/055 5/420
3,741,540 A * 6/1973 Shimizu ..... A63B 22/0056 482/80
4,279,415 A * 7/1981 Katz ..... A63B 69/0035 36/7.8
4,669,722 A * 6/1987 Rangaswamy ..... A43B 1/0054 36/28
5,186,700 A * 2/1993 Wang ..... A63B 21/0085 482/111
5,230,675 A * 7/1993 Lin ..... A63B 22/0056 482/53
5,267,923 A * 12/1993 Piaget ..... A63B 21/0085 482/52
5,277,677 A * 1/1994 Terauds ..... A63B 22/0056 482/53
5,626,539 A * 5/1997 Piaget ..... A63B 22/0056 482/52
5,851,166 A * 12/1998 Bernardson ..... A63B 22/16 482/79
6,106,439 A * 8/2000 Boland ..... A63B 23/1209 482/51
6,572,514 B1 * 6/2003 Calafato ..... A63B 22/0056 482/79
7,901,332 B1 * 3/2011 Wen ..... A63B 22/205 482/51
8,784,277 B2 * 7/2014 Prats ..... A63B 22/0056 482/53
9,254,404 B2 * 2/2016 Prats ..... A63B 71/0619
9,676,452 B2 * 6/2017 Nowack ..... B63B 17/0081
2003/0092538 A1 * 5/2003 Kuo ..... A63B 22/0056 482/79
2004/0192514 A1 * 9/2004 Piaget ..... A63B 22/0056 482/54
2004/0214693 A1 * 10/2004 Piaget ..... A63B 22/0056 482/52
2004/0266586 A1 * 12/2004 Palmer ..... A63B 21/028 482/52
2005/0164836 A1 * 7/2005 Harker ..... A63B 21/023 482/52
2005/0233864 A1 * 10/2005 Smith ..... A63B 22/0056 482/52
2005/0277518 A1 * 12/2005 Fan ..... A63B 22/0056 482/52
2006/0276311 A1 * 12/2006 Martin ..... A63B 21/00065 482/92
2007/0202996 A1 * 8/2007 Lu ..... A63B 22/0056 482/52
2009/0163325 A1 * 6/2009 Piaget ..... A63B 21/0085 482/53
2010/0087299 A1 * 4/2010 Babiarz ..... A63B 21/00069 482/142
2011/0045955 A1 * 2/2011 Savane ..... A63B 22/0056 482/52
2011/0111927 A1 * 5/2011 Kim ..... A63B 21/00192 482/52
2011/0263398 A1 * 10/2011 Klassen ..... A63B 22/16 482/146
2011/0269603 A1 * 11/2011 Lin ..... A63B 21/00069 482/111
2013/0345028 A1 * 12/2013 Bes ..... A63B 5/11 482/79
2015/0080192 A1 * 3/2015 Szabo ..... A63B 21/4015 482/66
2016/0175654 A1 * 6/2016 Harwin ..... A63B 26/003 482/142
2016/0271439 A1 * 9/2016 Chuang ..... A63B 21/023
2017/0072257 A1 * 3/2017 Licklider ..... A63B 5/08

* cited by examiner

ADJUSTABLE-WIDTH PORTABLE BALANCING PLATFORM

CROSS-REFERENCE TO RELATED APPLICATION

This application is a divisional of U.S. patent application Ser. No. 16/149,431, filed Oct. 2, 2018.

FIELD

This invention relates to the field of exercise devices and more particularly to a device that permits balance and posture practice.

BACKGROUND

For the young and old, balance is a critical element of stability.

Without balance one is more likely to fall, or to require balance aids such as canes, wheelchairs, or walkers. Even those with good balance may wish to practice to improve their balance to improve their performance in sports.

Balance is a complex skill because of its many parts. One's sense of balance is formed from the combination of multiple portions of the human body, from the inner ear to the sense of touch in the feet. Muscle strength and coordination also play a role, as one must be able to make the corrections necessary to compensate.

Without balance, one's ability to move is compromised, which affects independence. Thus, being able to practice and develop balance is critical to securing and maintaining independence.

What is needed is a portable balance practice device for users of all ages and sizes.

SUMMARY

The portable balancing device is formed from two modules connected by a width-adjusting mechanism.

The primary component of the portable balancing platform is a module. Each module may also be referred to as half of the pair of modules. Each module is formed from an upper platform and a lower platform. The upper and lower platform are separated by compressible elements that deform under a user's weight.

In the preferred embodiment, the compressible elements are secured to the upper and lower platforms using an adhesive, or other type of non-removable bonding.

In an alternative embodiment, the compressible elements are secured to the upper and lower platforms using a removable adhesive or removable fasteners.

Prior to the application of a load, the upper and lower platforms are parallel. When load is applied, such as by a user's foot, the compressible elements deform. Depending upon where the load is applied, and the amount of load, the upper platform may no longer be parallel to the lower platform. And the two upper platforms may no longer be parallel to each other.

Roll is left-to-right rotation, and pitch is front-to-back rotation.

As the upper platforms roll and pitch, the user must shift his or her weight to avoid falling, thereby practicing balancing.

An optional width-adjusting mechanism that connects the modules permits a user to lock the modules at different distances from each other. Additionally, the user may separate the modules from each other to simply transportation or shipment. Platforms are held in a position with respect to each other by a width-adjusting mechanism.

The width-adjusting mechanism is shown as interlocking, slidably connected tubes with a releasable connector, but other mechanisms of adjustable length may be substituted.

The width-adjusting mechanism is affixed to the lower platforms, without connection to the upper platforms. Thus, the upper platforms may move independently of each other.

In an alternative embodiment, the two modules are joined by an extended lower platform that bridges the two upper platforms.

As a result of the extended lower platform, a width-adjusting mechanism is no longer necessary.

The upper platforms remain independent, thus the user must balance each foot independently.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
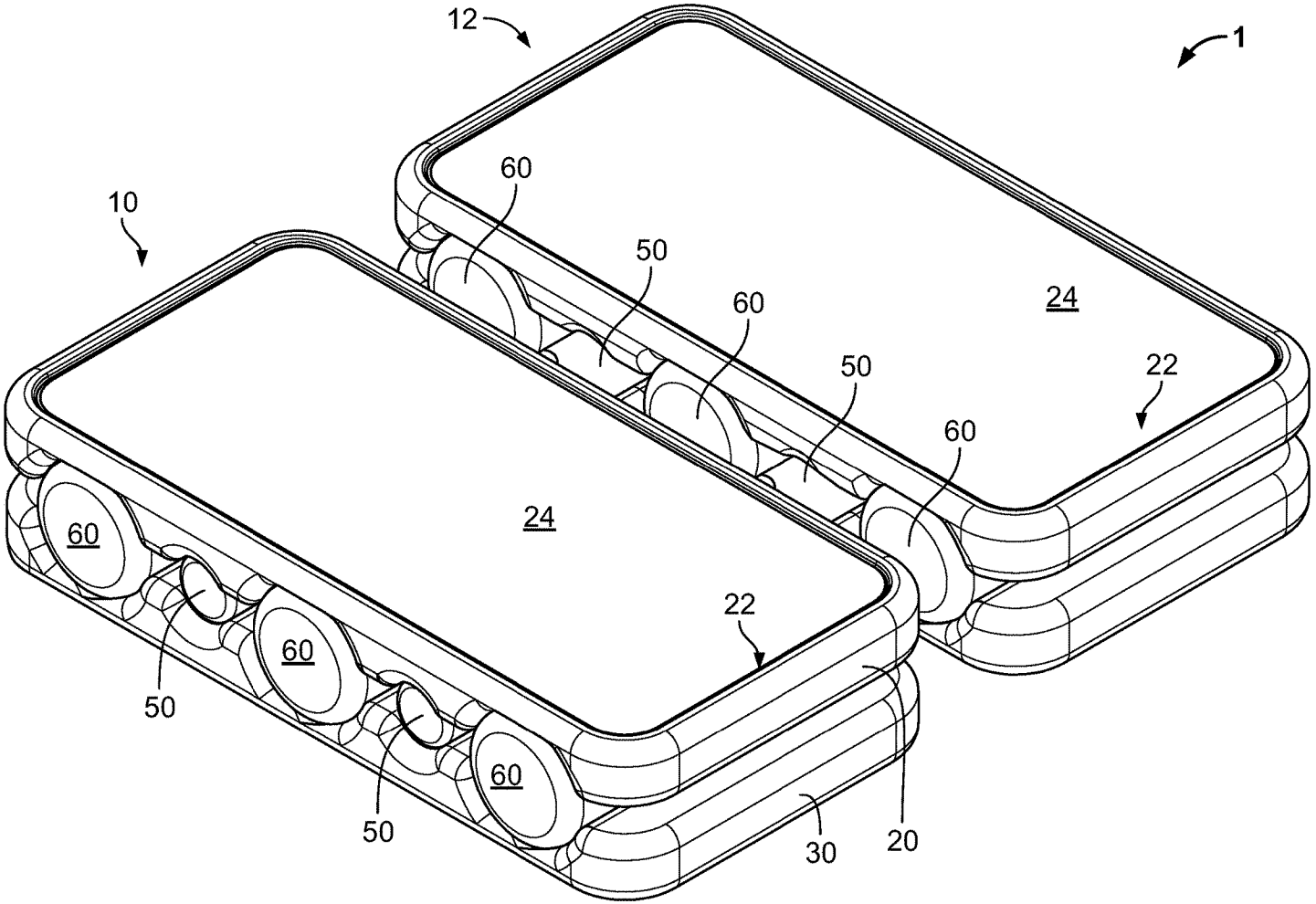
FIG. 1 illustrates an isometric view of a first embodiment in an assembled state.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a first embodiment is illustrated.

The portable balancing platform 1 is formed from a first module 10 and a second module 12. Each module 10/12 includes an upper platform 20 with an optional upper platform inset 22, into which is placed an upper anti-skid surface 24.

Also included in each module 10/12 is a lower platform 30.

The width-adjusting mechanism 50 is partially visible between the first module 10 and second module 12.

The multiple compressible elements 60 are also visible separating the upper platforms 20 from the lower platforms 30.

Figure 2:
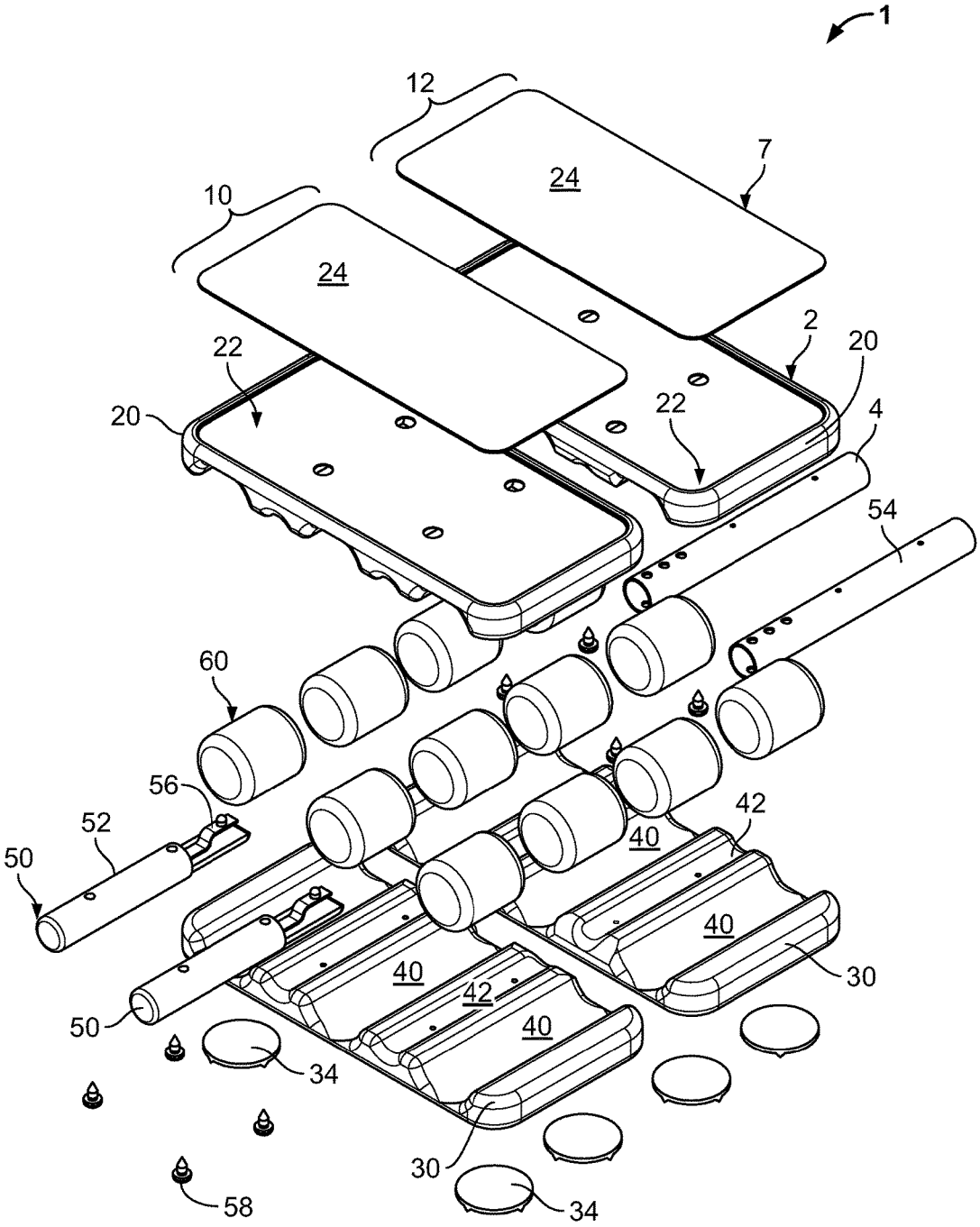
FIG. 2 illustrates an isometric view of a first embodiment in an exploded state.

Referring to FIG. 2, an isometric view of a first embodiment in an exploded state is illustrated.

The portable balancing platform 1 is again shown formed from the first module 10 and second module 12.

The upper anti-skid surface 24 is shown raised from the upper platform inset 22 of the upper platform 20.

The multiple compressible elements 60 are visible. In the preferred embodiment each compressible element 60 is a cylindrical shape, corresponding to rounded compressible element notches 40 in the upper platform 20 and lower platform 30.

The preferred embodiment includes three rows of compressible elements 60, but in alternative embodiments there are two rows, four rows, or a continuous pad.

The lower platform 30 is shown with the compressible element notches 40 and width-adjustment notches 42. The width-adjustment notches 42 cradle the width-adjusting mechanism 50, which is affixed to the lower platform 30 using one or more fasteners 58.

The width-adjusting mechanism 50 is preferably formed from an inner element 52 that slides into an outer element 54. The inner element 52 is held in place with respect to the outer element 54 by a releasable connector 56.

Figure 3:
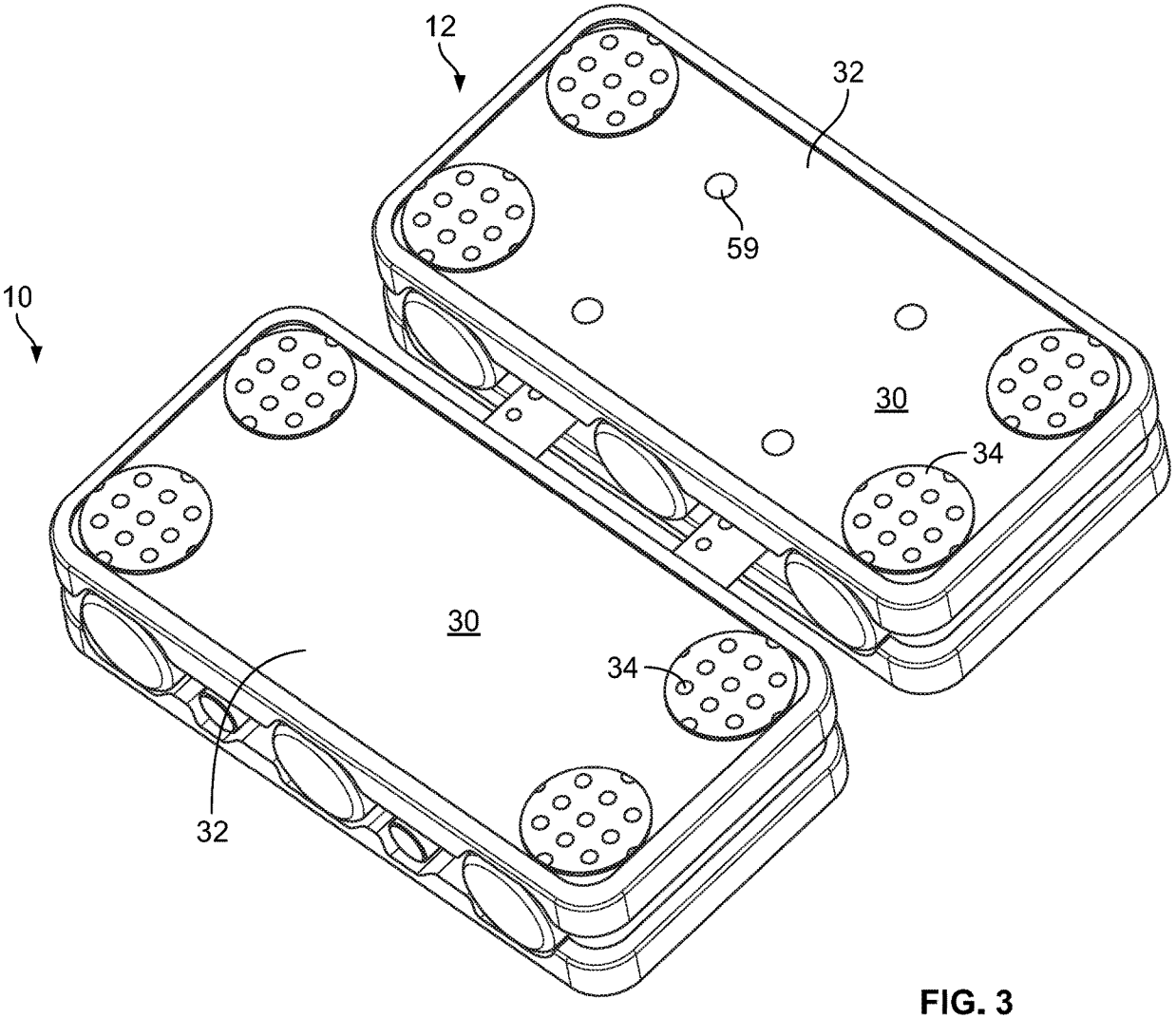
FIG. 3 illustrates an isometric view of the bottom of a first embodiment in an assembled state.

Referring to FIG. 3, an isometric view of the bottom of a first embodiment in an assembled state is illustrated.

Optional fastener caps 59 are shown to cover the fasteners 58 (See FIG. 2).

Lower platform 30 includes an optional lower platform inset 32. Further included are optional lower anti-slip feet 34 that help maintain the position of the portable balancing platform 1 with respect to the floor during use.

Figure 4:
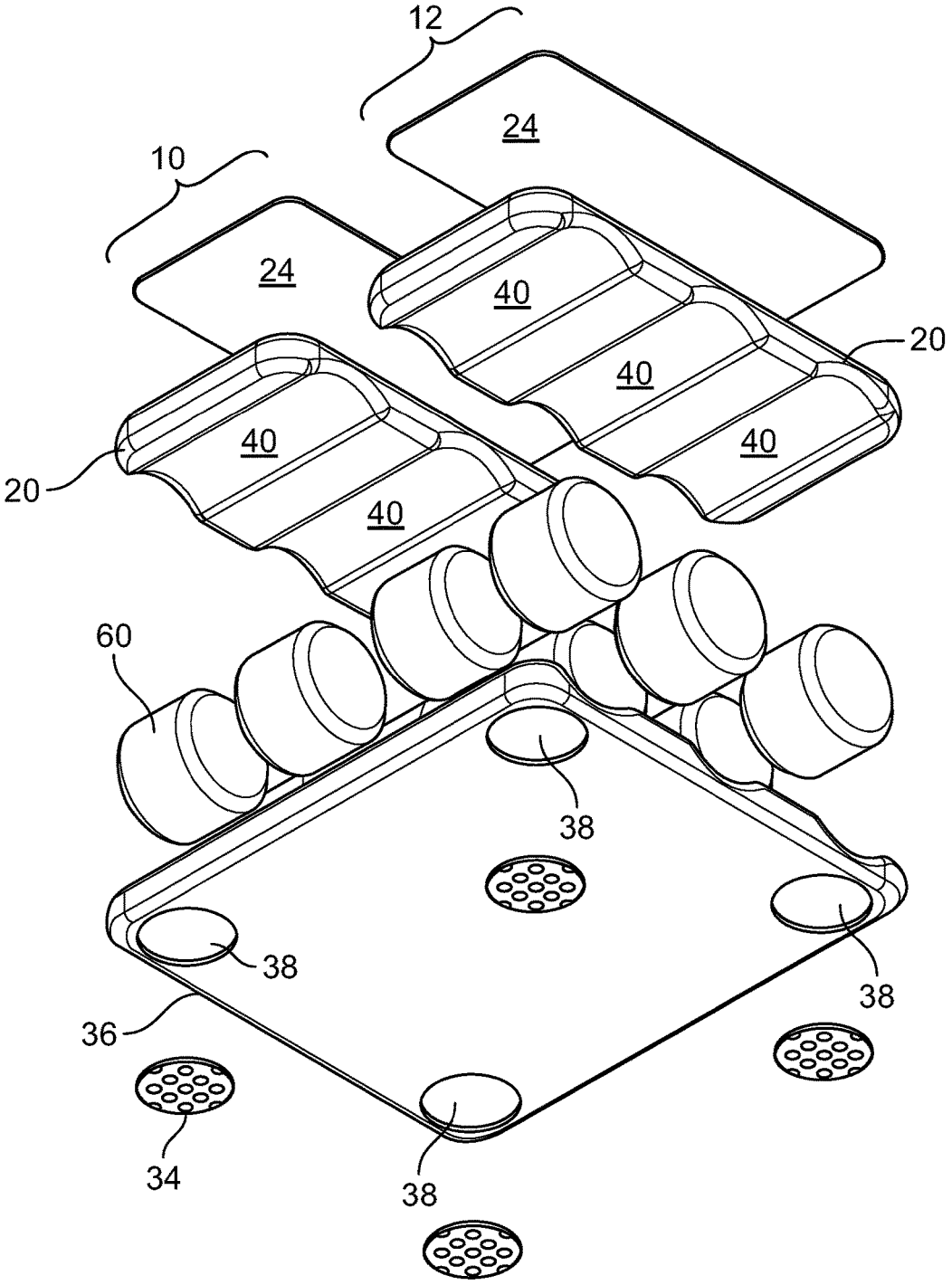
FIG. 4 illustrates an isometric view of a second embodiment in an exploded state.

Referring to FIG. 4, an isometric view of a second embodiment is shown in an exploded state.

The first module 10 and second module 12 are shown, each including an upper platform 20 and upper anti-skid surface 24.

The extended lower platform 36 bridges the first module 10 and second module 12. Despite the single lower platform, the first module 10 and second module 12 retain independent compressible elements 60 within compressible element notches 40, thereby requiring independent balance of each user's foot.

Optional lower foot insets 38 support lower anti-slip feet 34.

Figure 5:
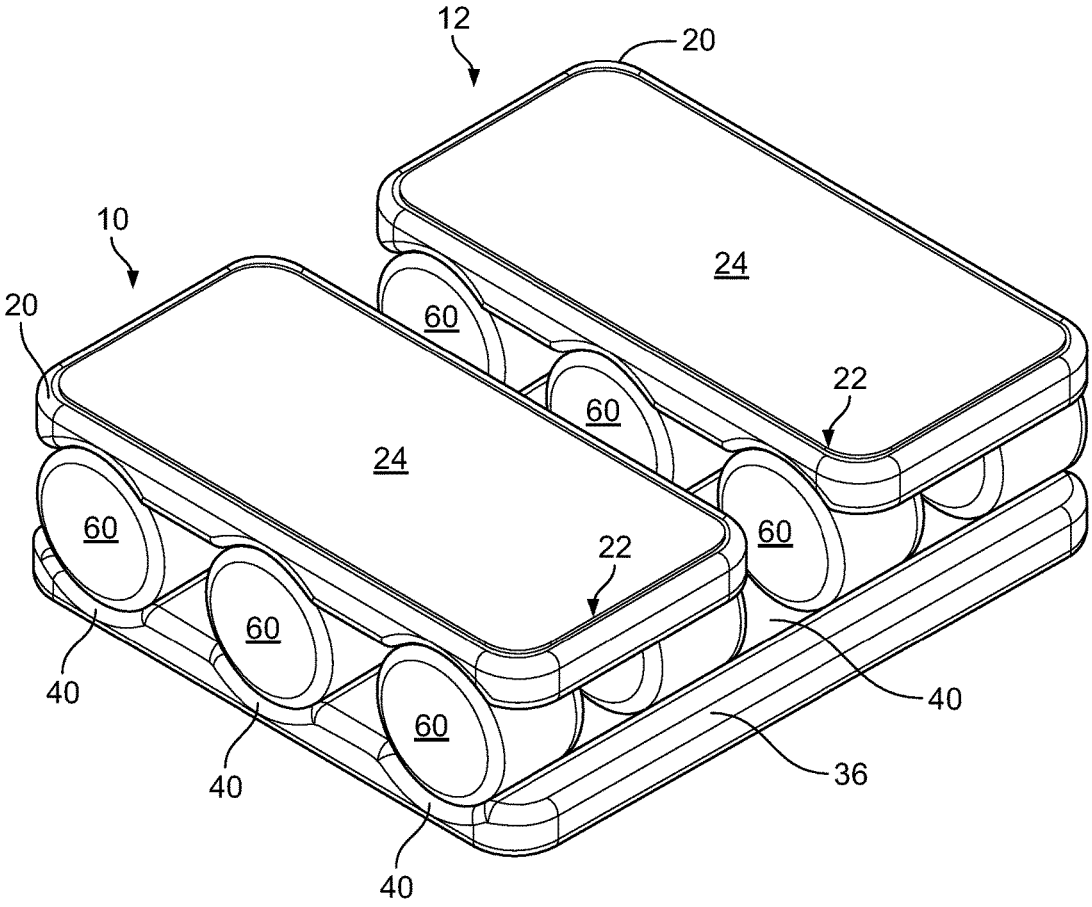
FIG. 5 illustrates an isometric view of a second embodiment in an assembled state.

Referring to FIG. 5, an isometric view of a second embodiment is shown in an assembled state.

Again shown are the first module 10 and second module 12, each with an upper platform 20 separated from the extended lower platform 36 by multiple compressible elements 60. The compressible elements 60 sit within compressible element notches 40.

Each upper platform 20 optionally includes an upper platform inset 22 with upper anti-skid surface 24.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A balance device having an adjustable width, the balance device comprising:

a first module and a second module, each of the first and second modules including:

an upper platform and a lower platform, the upper platform being parallel to the lower platform prior to an application of a load on the upper platform; and a set of compressible elements between the upper platform and the lower platform;

wherein the set of compressible elements allows independent rotation of the upper platform relative to the lower platform in a left-to-right rotation through roll and in a front-to-back rotation through pitch, the roll and the pitch of the upper platform relative to the lower platform allowing for balance practice;

wherein mechanical communication between the set of compressible elements of the first module and the set of compressible elements of the second module is disconnected; and a width-adjusting mechanism connecting the first module to the second module that provides for the adjustable width, the adjustable width being a selectively spaced apart distance between the first and second modules.

2. The balance device of claim 1, wherein each compressible element in the set of compressible elements is cylindrically shaped.

3. The balance device of claim 1, wherein the width-adjusting mechanism is formed from:

an inner element and an outer element, the inner element slidably connected to the outer element;

a releasable connector acting to fix a position of the inner element with respect to the outer element.

4. The balance device of claim 1, further comprising:

notches within each upper platform and each lower platform, the notches respectively cradling each compressible element in the respective set of compressible elements.

5. A balance device that separates into two halves to simplify transportation of the balance device, the balance device comprising:

a first half formed from:

a first upper platform with a first upper platform inset, a first upper anti-skid surface being within the first upper platform inset;

a first lower platform with a first lower surface, one or more first lower anti-slip feet being affixed to the first lower surface; and a first set of compressible elements between the first upper platform and the first lower platform;

wherein the first upper platform is parallel to the first lower platform prior to an application of a load on the first upper platform; and wherein the first set of compressible elements allows independent rotation of the first upper platform relative to the first lower platform in a left-to-right rotation of the first upper platform through roll of the first upper platform and in a front-to-back rotation of the first upper platform through pitch of the first upper platform;

whereby an application of pressure to the first upper platform causes compression of the first set of compressible elements, resulting in an instability of the first upper platform relative to the first lower platform due to the roll and/or the pitch of the first upper platform;

a second half formed from:

a second upper platform with a second upper platform inset, a second upper anti-skid surface being within the second upper platform inset;

a second lower platform with a second lower surface, one or more second lower anti-slip feet being affixed to the second lower surface; and a second set of compressible elements between the second upper platform and the second lower platform;

wherein the second upper platform is parallel to the second lower platform prior to an application of a load on the second upper platform; and wherein the second set of compressible elements allows independent rotation of the second upper platform relative to the second lower platform in a left-to-right rotation of the second upper platform through roll of the second upper platform and in a front-to-back rotation of the second upper platform through pitch of the second upper platform;

whereby an application of pressure to the second upper platform causes compression of the second set of compressible elements, resulting in an instability of the second upper platform relative to the second lower platform due to the roll and/or the pitch of the second upper platform;

wherein mechanical communication between the first and second sets of compressible elements is disconnected; and a width-adjusting mechanism connecting the first half to the second half that provides for an adjustable width between the first half and the second half;

whereby the respective instabilities of the first and second upper platforms allow for balance practice.

6. The balance device of claim 5, wherein each compressible element in the first and second sets of compressible elements has a cylindrical shape.

7. The balance device of claim 5, wherein the width-adjusting mechanism is formed from:

an inner element and an outer element, the inner element slidably connected to the outer element;

a releasable connector acting to fix a position of the inner element with respect to the outer element.

8. The balance device of claim 5, further comprising:

notches respectively within the first and second upper platforms and the first and second lower platforms, the notches respectively cradling each compressible element in the respective first and second sets of compressible elements.

* * * * *